US005390929A

United States Patent [19]

Todaro

[11] Patent Number: 5,390,929

[45] Date of Patent: Feb. 21, 1995

[54] APPARATUS FOR GUIDING A GOLF SWING

[75] Inventor: Frank Todaro, San Ramon, Calif.

[73] Assignee: Turn & Strike Golf Systems Inc., Grants Pass, Oreg.

[21] Appl. No.: 101,703

[22] Filed: Aug. 4, 1993

[51] Int. Cl.[6] ..... A63B 69/36

[52] U.S. Cl. ..... 273/187.2; 273/189 R

[58] Field of Search ..... 273/189 R, 187.2, 191 R, 273/191 A, 191 B, 192, 188 R

[56] References Cited

U.S. PATENT DOCUMENTS

| | | | |
|---|---|---|---|
| 2,773,691 | 12/1956 | Redfield | 273/189 R |
| 3,419,277 | 12/1968 | Martin | 273/189 R |
| 3,429,571 | 2/1969 | Abel, Jr. | 273/26 |
| 3,623,733 | 11/1971 | Cavanaugh | 273/188 R X |
| 3,820,794 | 6/1974 | Inoue | 273/189 R X |
| 4,061,340 | 12/1977 | Husted | 273/189 R |
| 4,257,597 | 3/1981 | Pennybaker | 273/187.2 |
| 4,422,643 | 12/1983 | Cushing | 273/191 R X |
| 4,479,653 | 10/1984 | Woodson | 273/191 B X |
| 4,688,800 | 8/1987 | Lopez | 273/189 R X |
| 4,883,276 | 11/1989 | Brown | 273/191 R X |
| 5,203,567 | 4/1993 | Erlinger et al. | 273/187.2 |

FOREIGN PATENT DOCUMENTS

| | | | |
|---|---|---|---|
| 2129692 | 5/1984 | United Kingdom | 273/189 R |

*Primary Examiner*—George J. Marlo
*Attorney, Agent, or Firm*—Thomas R. Lampe

[57] ABSTRACT

Apparatus for guiding a golf swing which includes an elongated guide member projecting outwardly from a panel attached at the golfer's waist. The elongated guide member is for engagement by an arm of the wearer during the swing and includes at least one recess for receiving the golfer's arm and promoting proper positioning of the arm relative to hip movement during the swing.

8 Claims, 9 Drawing Sheets

APPARATUS FOR GUIDING A GOLF SWING

TECHNICAL FIELD

This invention relates to the sport of golf. More particularly, the invention is an apparatus to be worn by a golfer for guiding the wearer's golf swing to improve his or her golf shots. The apparatus can be readily adjusted relative to the wearer's body to provide a guide for the swing for both long drives and shorter shots and to accommodate the ability of the golfer.

BACKGROUND ART

A wide variety of golf swing trainer devices have been invented, ranging from the quite complex to the relatively simple. For example, the following United States patents disclose devices which purportedly train a golfer or improve his or her swing: U.S. Pat. No. 4,688,800, issued Aug. 25, 1987, U.S. Pat. No. 4,479,653, issued Oct. 30, 1984, U.S. Pat. No. 4,422,643, issued Dec. 27, 1983, U.S. Pat. No. 5,203,567, issued Apr. 20, 1993, U.S. Pat. No. 4,883,276, issued Nov. 28, 1989, U.S. Pat. No. 4,257,597, issued Mar. 24, 1981, U.S. Pat. No. 3,820,794, issued Jun. 28, 1974, U.S. Pat. No. 3,623,733, issued Nov. 30, 1971, U.S. Pat. No. 2,773,691, issued Dec. 11, 1956, and U.S. Pat. No. 3,429,571, issued Feb. 25, 1969.

Some of the prior art devices are ungainly and awkward to use. A common deficiency of the prior art devices also resides in the fact that they interfere with the natural movement of the golfer's body when taking a swing or cause a golfer to concentrate on one particular element of the swing to the detriment of other elements. Furthermore, many devices are suitable for usage only when making a certain type of swing such as a drive. Some of the prior art approaches are characterized by their relatively complex construction and high expense.

U.S. Pat. No. 4,688,800, issued Aug. 25, 1987, is worthy of special note. Such patent discloses a golf swing guide having a generally triangular configuration which allegedly acts as an aid when teaching golf to a student. The guide of U.S. Pat. No. 4,688,800suffers from a number of deficiencies. Being essentially flat in construction, the triangular guide will bend downwardly when the golfer bends his or her body, as is often the case. In addition, the sides of the guide are essentially flat and do not provide a high degree of guidance for the golfer's arm. An important element in the golf swing is that arm movement follow hip movement during at least portions of the back swing and the down swing. The guide of U.S. Pat. No. 4,688,800 would not appear to be completely effective in this regard, not only due to the flat sides employed but also due to the fact that the guide can tip or bend downwardly whether due to bending of the body of the golfer or for other reasons.

DISCLOSURE OF INVENTION

The apparatus of the present invention effectively promotes a proper golf swing. More particularly, the apparatus coordinates and guides arm movement in coordination with movement of the rest of the golfer's body, in particular the golfer's hips. The apparatus promotes the all important one piece take away and helps keep the golfer's body balanced. It will assist the golfer in the completion of a full turn which will provide greater distance and accuracy.

The apparatus is so constructed as to promote correct weight shift during the swing and placement of the lower body into the down swing ahead of arms, shoulder and hands. It assists the golfer in staying behind the ball at impact, one of the most important factors of the golf swing.

The apparatus is of relatively simple, inexpensive construction and its design does not hinder or restrict the golfer when making his or her swing. It does, however, guide the golfer in making a complete and correct series of moves in his or her swing that will result in more accurate shots and greater distance.

The apparatus of the present invention is to be worn by a golfer for guiding the wearer's golf swing when hitting a ball to a target location spaced from the wearer.

The apparatus includes attachment means for attaching the apparatus to the wearer's waist. Stabilizer means is provided for stabilizing the position of the apparatus relative to the wearer's waist when the apparatus is attached thereto by the attachment means.

The apparatus includes an elongated guide member having opposed sides secured to the stabilizer means and projecting outwardly from the stabilizer means. The elongated guide member is for engagement by at least one arm of the wearer during at least a portion of either the wearer's back swing or the wearer's downswing.

The elongated guide member has a free distal end spaced from the wearer's body and defines at least one recess for receiving an arm of the wearer. The stabilizer means maintains the free distal end positioned at a level above the wearer's waist during both the back swing and the down swing.

The elongated guide member includes a first guide member segment extending outwardly from the wearer's body substantially at right angles to the major axis of the wearer's body. A second guide member segment is connected to the first guide member segment at a location spaced from the wearer's waist, the second guide member segment extending upwardly a predetermined distance from the first guide member segment.

A third guide member segment is connected to and extends upwardly from the second guide member segment and the wearer's body, the third guide member segment terminating at said free distal end.

Other features, advantages, and objects of the present invention will become apparent with reference to the following description and accompanying drawings.

BEST MODE FOR CARRYING OUT THE INVENTION

Figure 1:
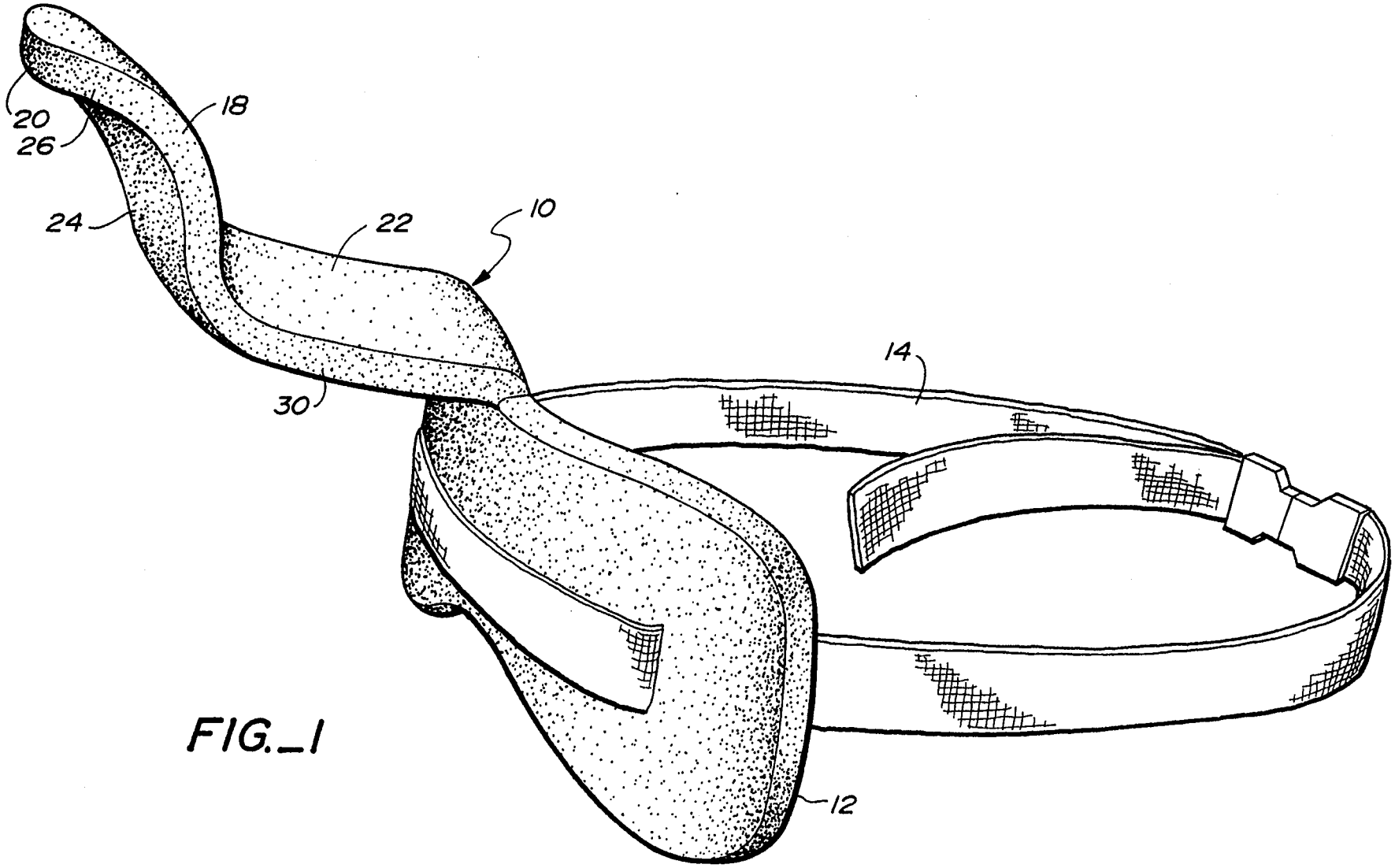
FIG. 1 is a perspective view of apparatus constructed in accordance with the teachings of the present invention.

Referring now to the drawings, apparatus constructed in accordance with the teachings of the present invention is designated by reference numeral 10. Apparatus 10 includes stabilizer means in the form of a flexible panel 12 which is positioned partially about the wearer's waist and in engagement therewith. The flexible panel 12 is held in position on the wearer by attachment means in the form of a selectively releasable, adjustable belt 14. The panel 12 is preferably relatively flexible so that it generally conforms to the configuration of the wearer's waist when the apparatus 10 is attached to the golfer.

An elongated guide member 18 is secured to panel 12 and projects outwardly therefrom. Elongated guide member 18 is to be engaged by at least one arm of the golfer wearing the apparatus during at least a portion of either the wearer's back swing or the wearer's down swing.

The elongated guide member 18 has a free distal end 20 which is spaced from the wearer's body. The panel 12 maintains the free distal end 20 positioned at a level above the wearer's waist during both the back swing and the down swing. This will ensure that the elongated guide member will be engageable by the golfer's arm when desired even when the golfer bends over. Also, the location of the free distal end may be more readily observed by the wearer due to its elevated position.

Elongated guide member 18 includes a first guide member segment 22 extending outwardly from the wearer's body substantially at right angles to the major axis of the wearer's body. A second guide member segment 24 is connected to the first guide member segment at a location spaced from the wearer's waist, the second guide member segment 24 extending upwardly a predetermined distance from the first guide member segment.

A third guide member segment 26 is connected to and extends outwardly away from the second guide member segment. The third guide member segment 26 extends outwardly away from the wearer's body. The third guide member segment terminates at the free distal end 20.

The elongated guide member 18 is curved to define a recess 30 located between the free distal end 20 and the stabilizer means or belt 14.

The recess 30 is located at the side of the elongated guide member 18 facing the target location and is for receiving an arm of the wearer during a portion of either the back swing or the down swing dependent upon placement of the apparatus on the user's body as well as the type of swing, as will be described in greater detail below.

A second recess 32 is defined by the elongated guide member 18 at the side thereof opposed to the target location for receiving an arm of the wearer during a portion of either the back swing or the down swing, again dependent upon placement of the apparatus relative to the golfer and the type of swing he or she is carrying out. Again, this aspect of the invention will be discussed in more detail below.

Figure 2:
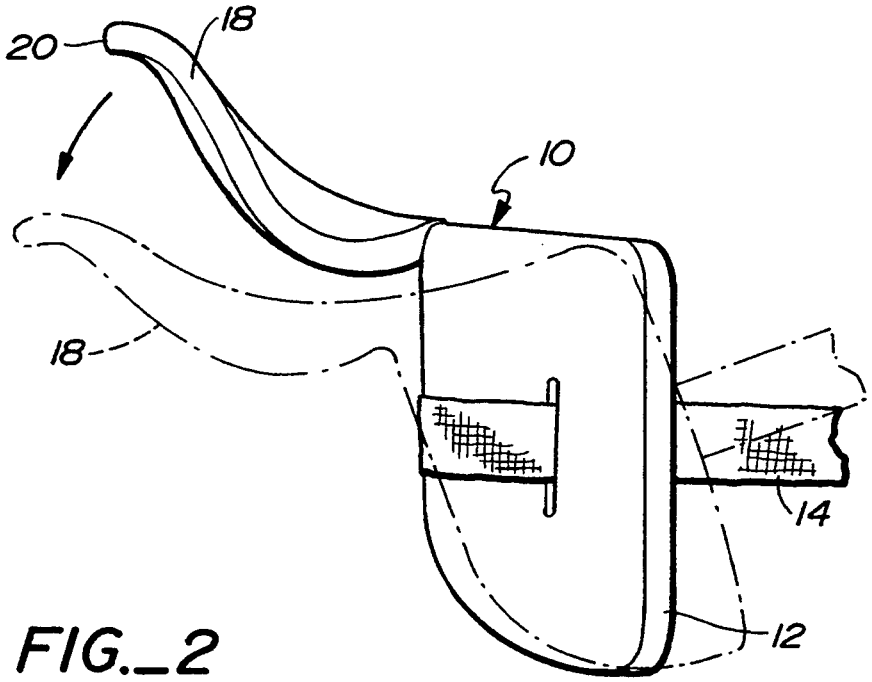
FIG. 2 is a side elevational view of the apparatus illustrating the apparatus in alternative positions.
Figure 4:
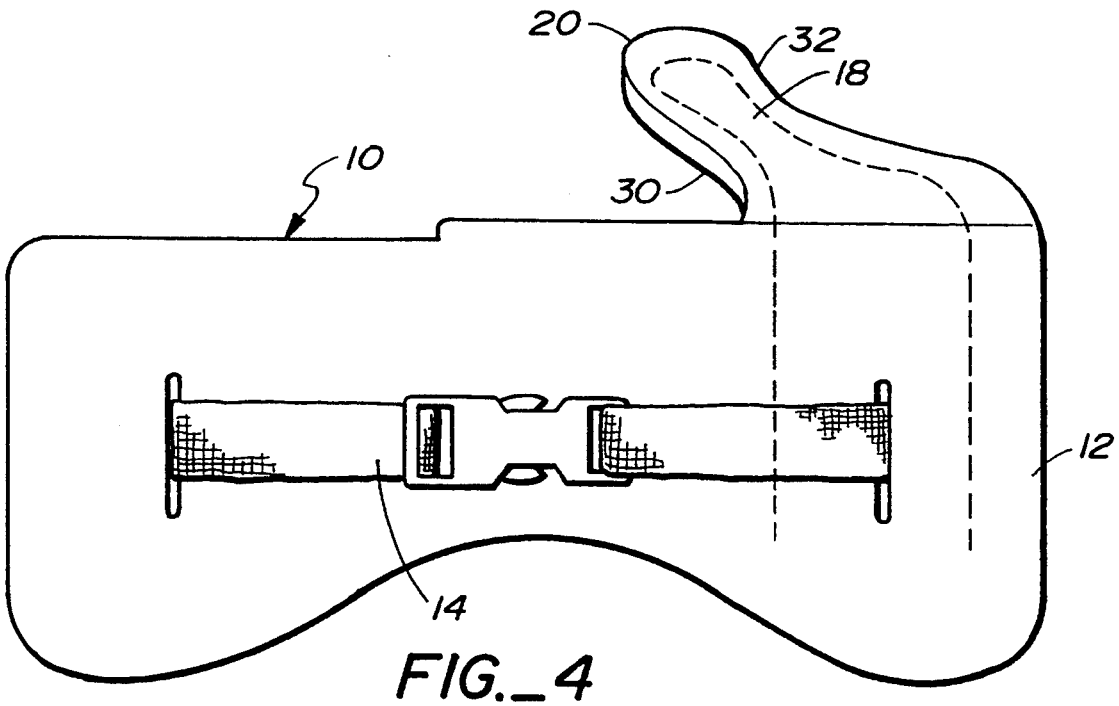
FIG. 4 is a back view of the apparatus.
Figure 3:
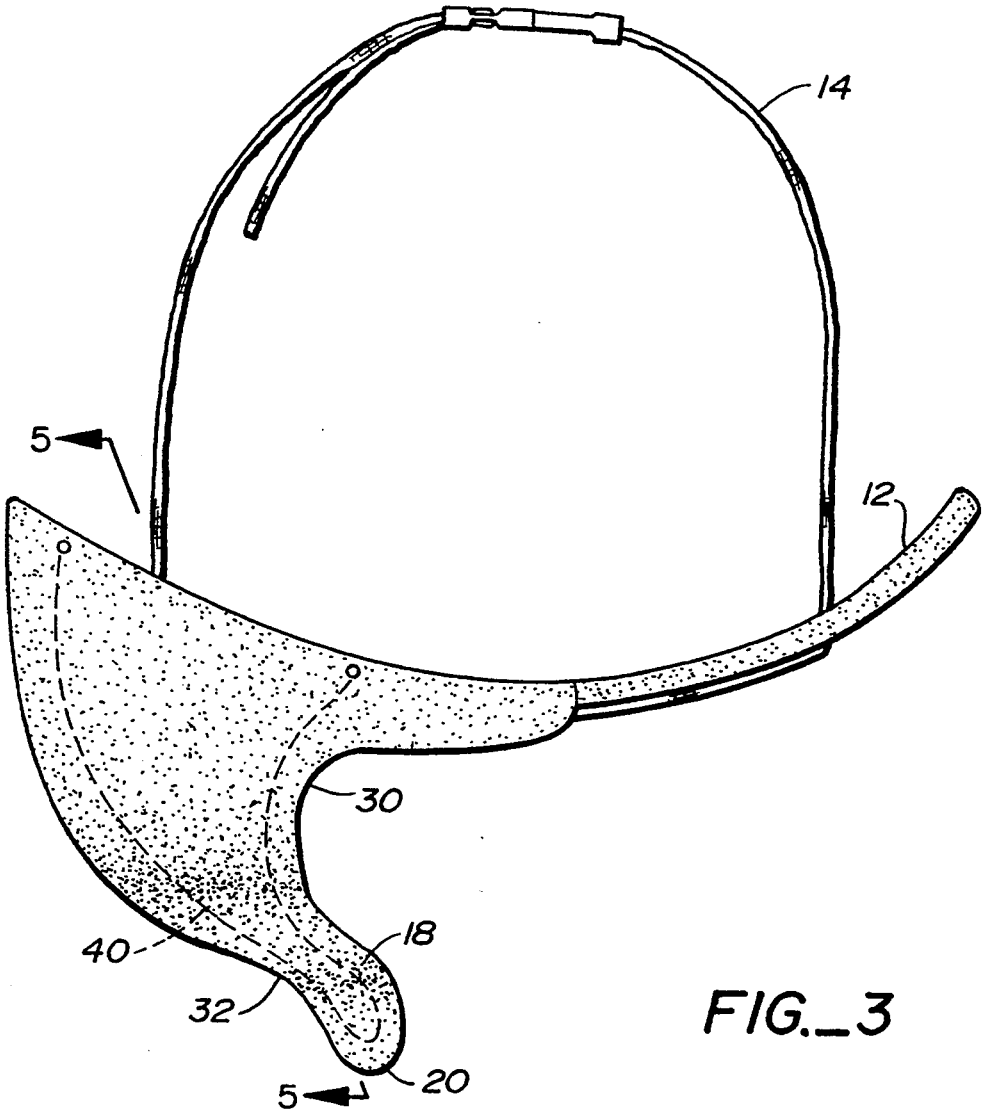
FIG. 3 is a top view of the apparatus.
Figure 5:
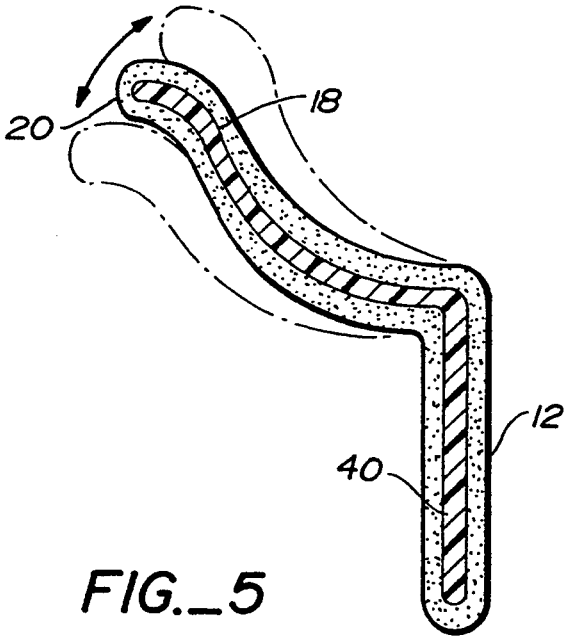
FIG. 5 is a cross-sectional view taken along the line 5—5 in FIG. 3.
Figure 5A:
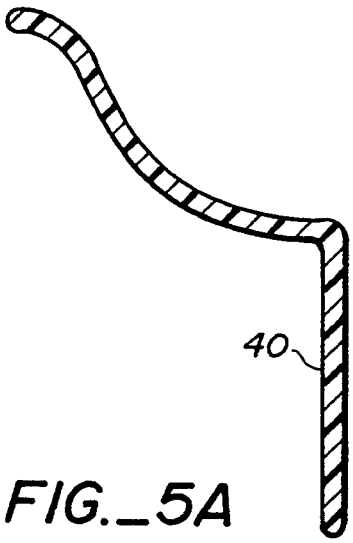
FIG. 5A is a cross-sectional view of a stiffener which may be employed in the construction of the apparatus.

Insofar as construction of the apparatus 10 is concerned, it is preferred that the apparatus be of relatively light-weight construction. For example, in the disclosed embodiment of the apparatus, the band or panel 12 and the elongated guide member 18 are of unitary construction and molded from light-weight material such as plastic foam. To add to the stability of such an arrangement, a stiffener element 40 (see FIGS. 3, 5, and 5A) may be embedded in the elongated guide member and panel. Of course, such an arrangement will allow a certain amount of deformation of the apparatus as illustrated in FIG. 5 wherein the distal end may flex under contact. Even when such flexing occurs, the distal end will be disposed above the waist of the user even when the user bends. This is shown, for example, in FIG. 2.

Figure 6:
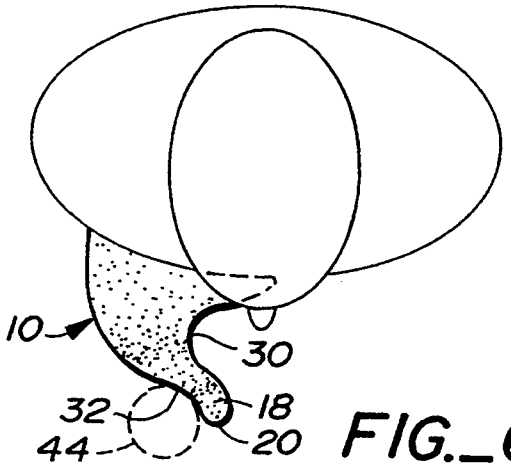
FIGS. 6, 6A, and 6B are schematic elevational views illustrating alternative positioning of the apparatus on a wearer's body.
Figure 6A:
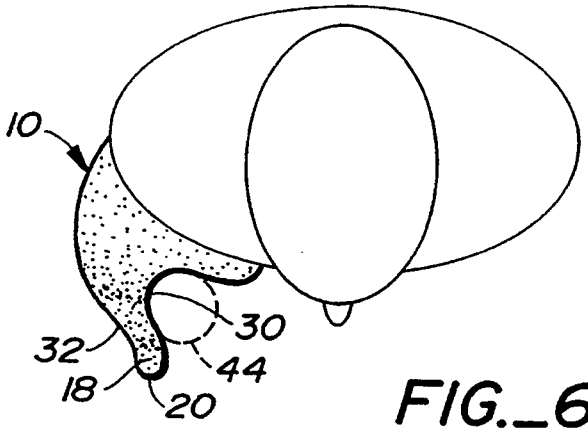
Figure 6B:
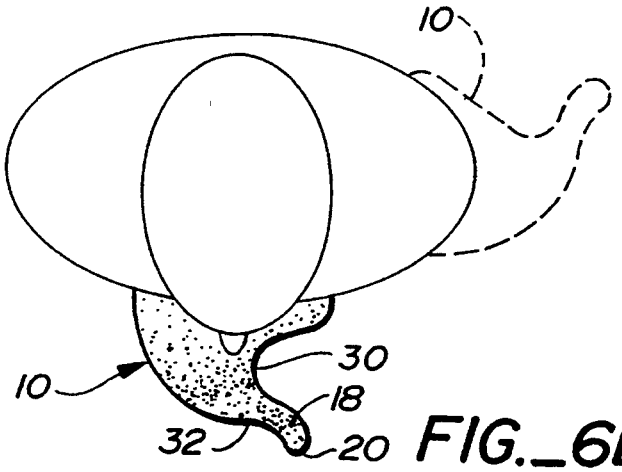

Referring now to FIGS. 6, 6A, and 6B, such figures illustrate how the apparatus 10 may be positioned at alternative locations relative to the golfer's body. FIGS. 6 and 6A diagrammatically illustrate a golfer's arm 44 in engagement with the apparatus 10 and nested in either recess 32 (FIG. 6A) or recess 30 (FIG. 6).

It will be noted that in FIG. 6 the apparatus 10 is positioned closer to the center of the user's body than it is in the FIG. 6A position. However, either placement is suitable for use by a golfer making a full swing, depending upon how much hip rotation is desired. With apparatus 10 in the FIG. 6 position, when the golfer is at the beginning of his swing, less rotation will occur in the hip during the swing than is the case when the apparatus 10 is in the FIG. 6A position with the golfer's arm settled in the recess 30.

Figure 8:
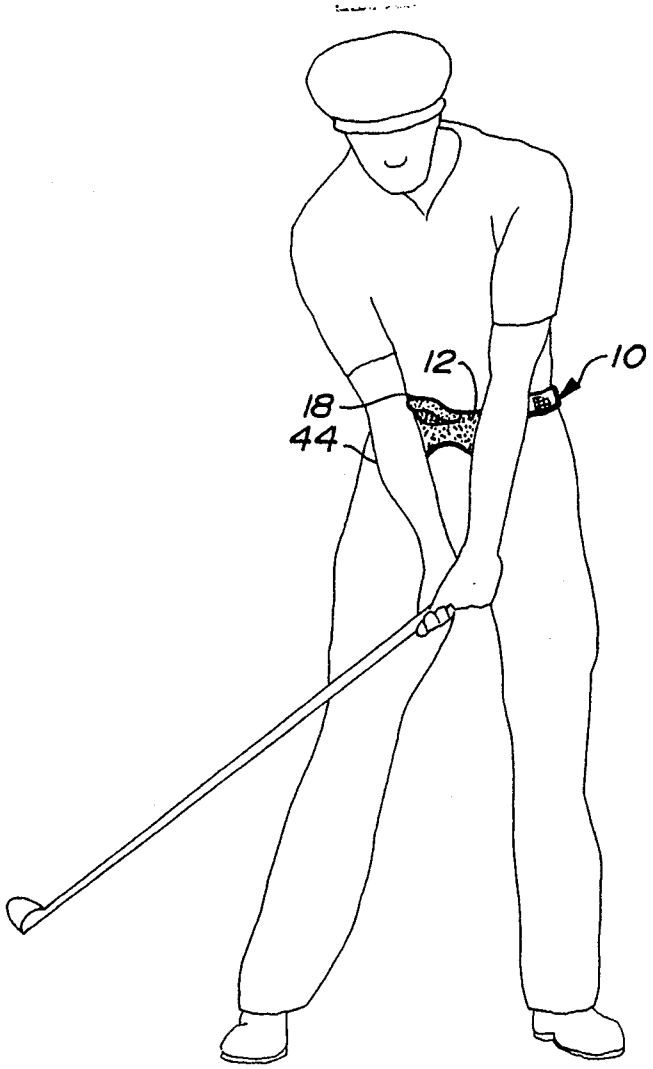
FIG. 8 is a frontal elevational view of a golfer wearing the apparatus in the position of FIG. 6 and during his back swing.
Figure 7:
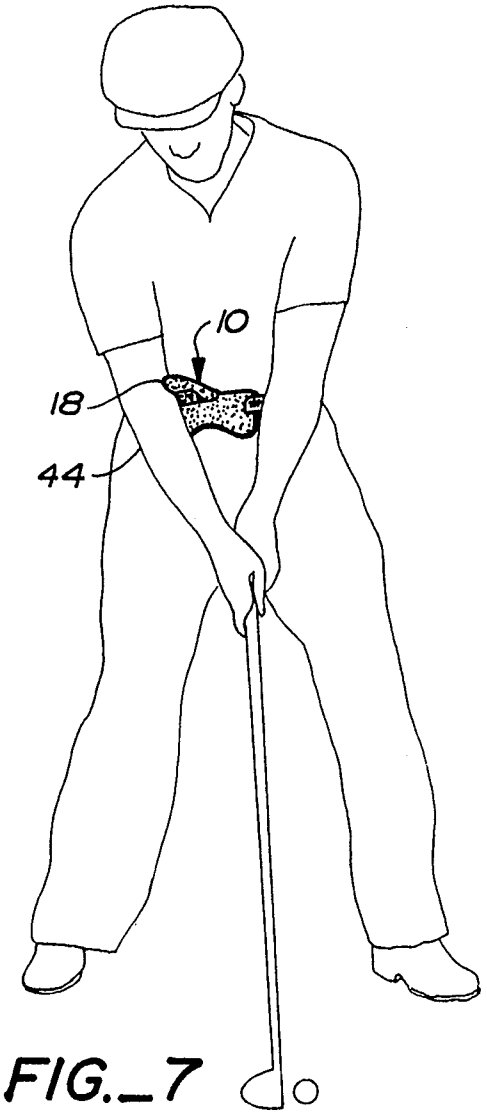
FIG. 7 is a front view of a golfer wearing the apparatus in the position shown in FIG. 6 prior to initiating his swing.
Figure 10A:
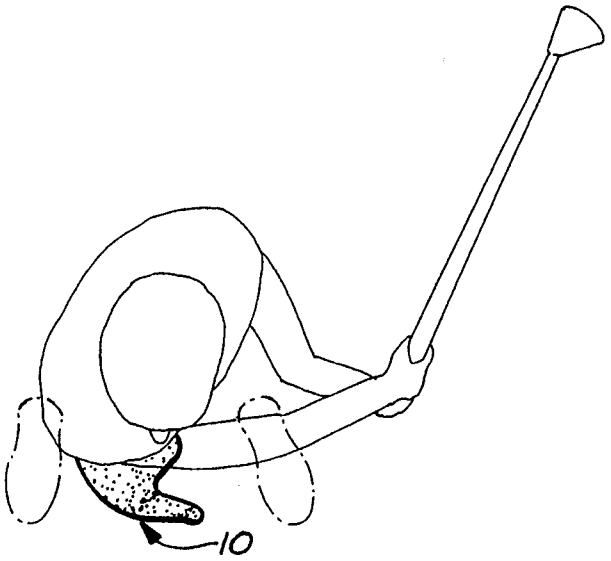
FIG. 10A is a top diagrammatic view of the golfer and apparatus in the positions shown in FIG. 10.
Figure 9A:
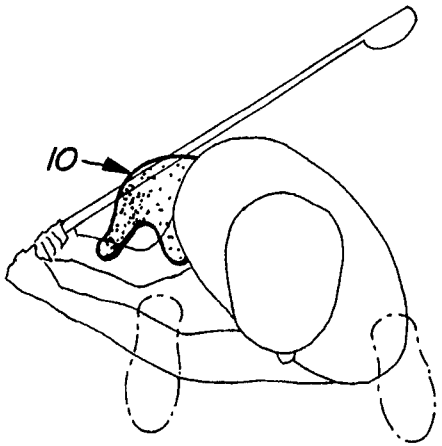
FIG. 9A is a top, diagrammatic view of the golfer and apparatus as shown in the position of FIG. 9.
Figure 10:
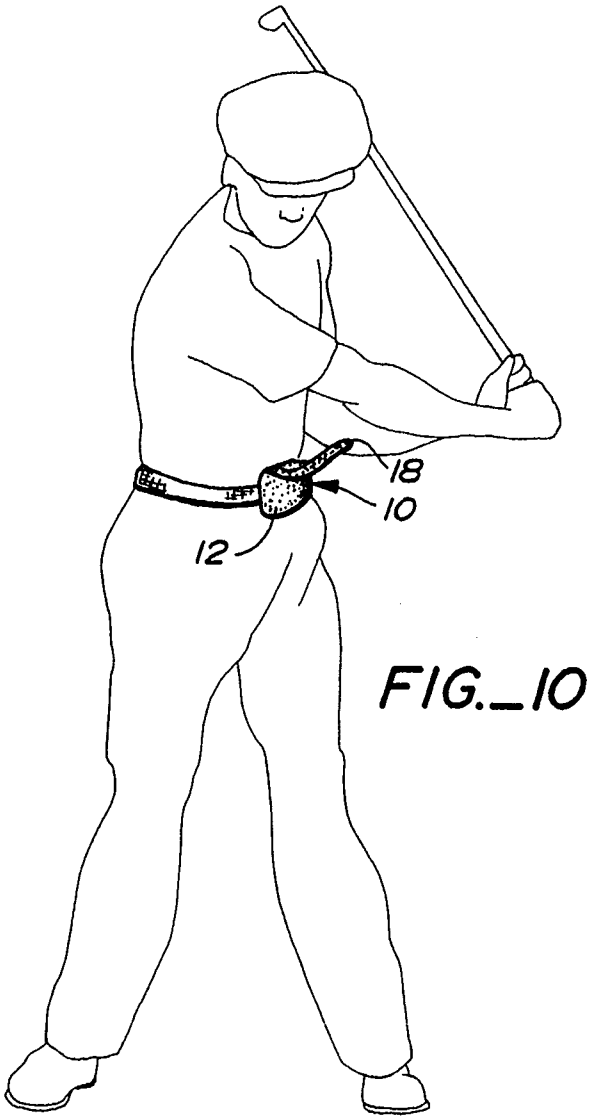
FIG. 10 is a front elevational view of a golfer wearing the apparatus in the position shown in FIG. 6 after having completed his down swing.
Figure 9:
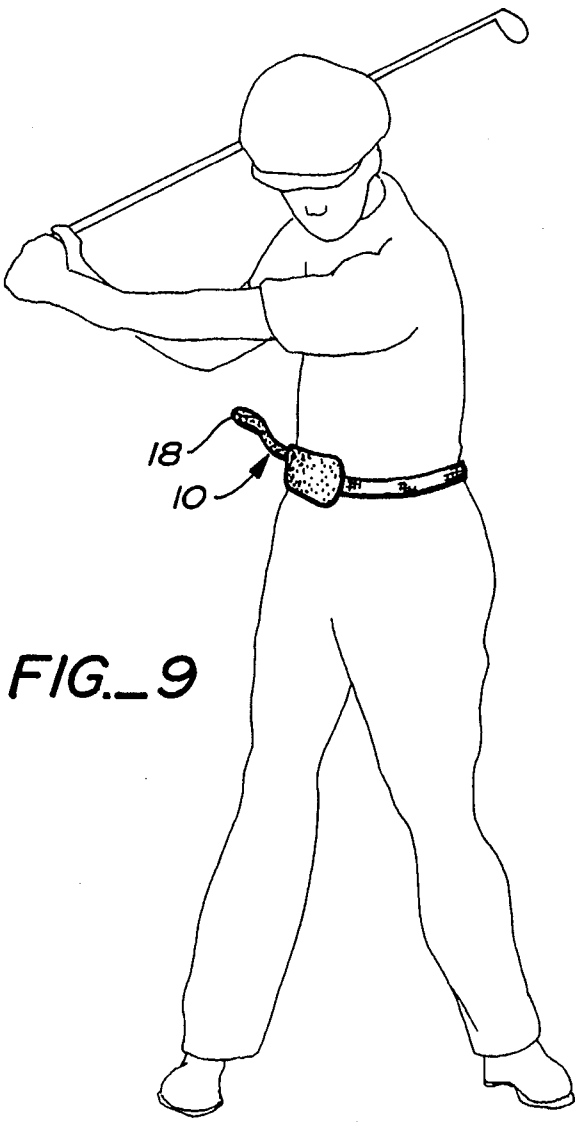
FIG. 9 is a frontal elevational view of a golfer at the top of his swing with the apparatus shown in the position of FIG. 6.

FIGS. 7, 8, 9, and 10 illustrate the sequence of positions assumed by a golfer during the course of his swing when the apparatus 10 is positioned in the location relative to his body shown in FIG. 6. In FIG. 7, the golfer is addressing the ball just prior to retracting the club head. In FIG. 8, the club head is withdrawn from the ball with the golfer's arm maintained in engagement with elongated guide member 18 and in the pocket or recess 32. Such engagement is maintained (which ensures that the arms will follow hip movement) until the upwardly moving arms are released from the apparatus 10 and the club is ready to begin its down swing, as shown in FIG. 9. In FIG. 10 the arms and the club have passed the apparatus 10 and the club is at the end of its swing. During the down swing, contact between the elongated guide member and the golfer's arms will let the golfer sense arm location and movement relative to hip location and movement, the object of course being not to allow arm movement to get in front of hip movement.

When one has considerable body mobility and wishes more hip action, the apparatus 10 is moved to the position shown in FIG. 6A and the golfer's arm 44 is nested in recess 30. Again, such an arrangement ensures that the arms will follow hip movement.

Figure 8A:
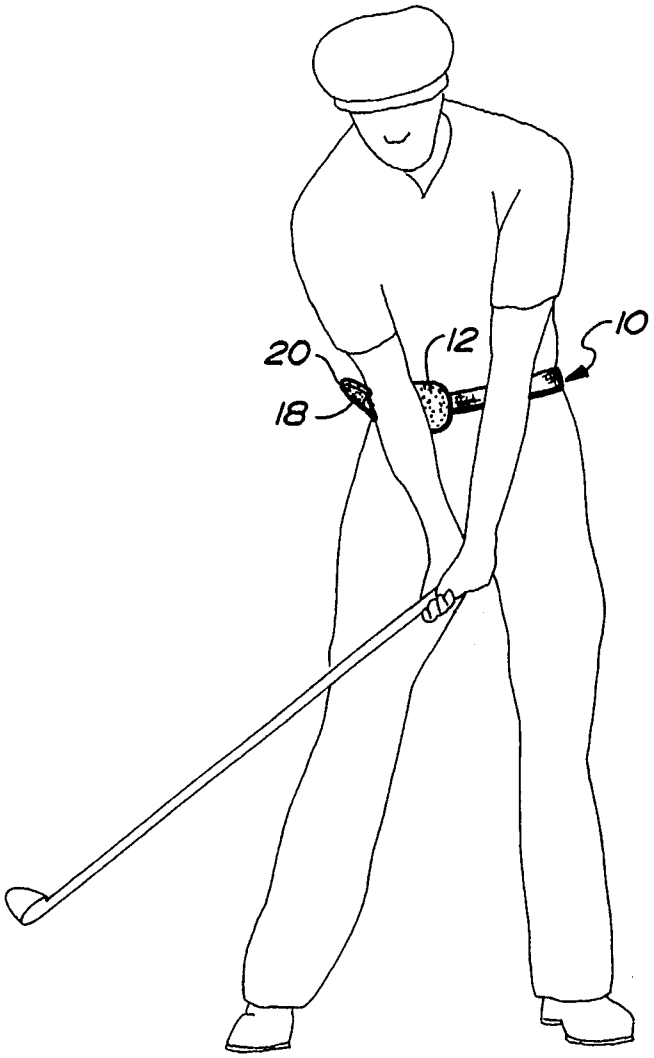
FIG. 8A is a view similar to FIG. 7A but illustrating the apparatus being worn in the position of FIG. 6A.
Figure 7A:
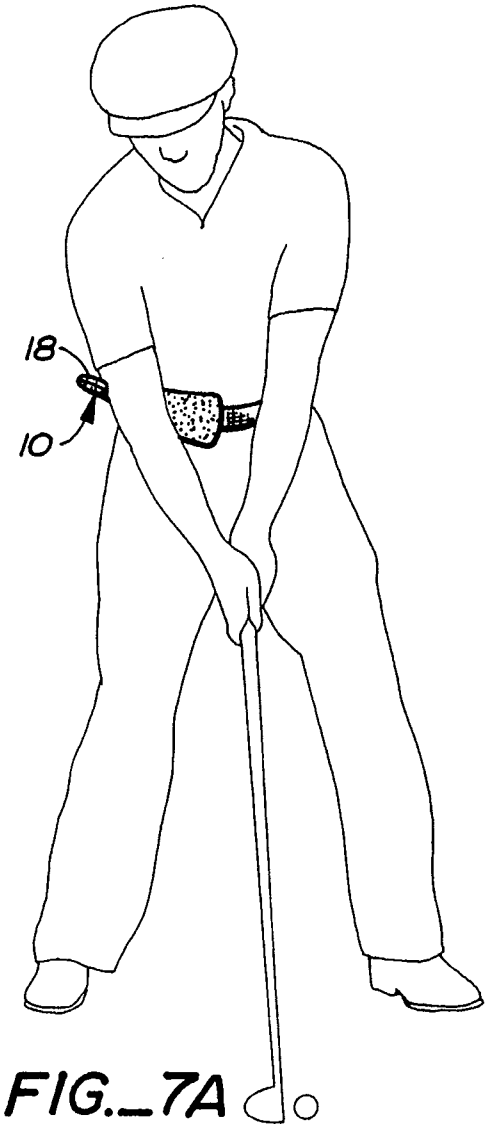
FIG. 7A is a view similar to FIG. 7 but illustrating the apparatus in the position of FIG. 6A.

FIG. 7A shows the apparatus 10 in the position of FIG. 6A with the golfer at the beginning of his swing. FIG. 8A shows the swing just underway.

Figure 7B:
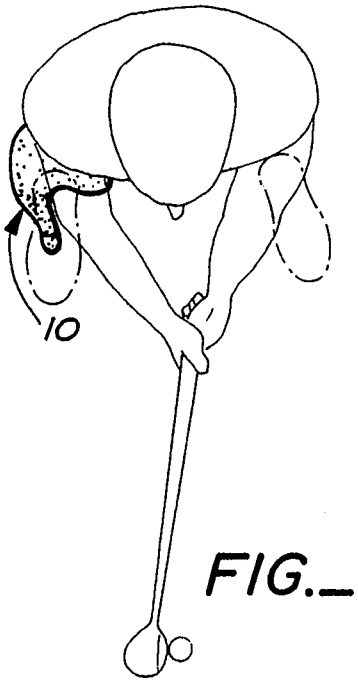
FIG. 7B is a top, schematic view of the golfer and apparatus of FIG. 7A.

FIG. 7B illustrated schematically in a top view the relative positions of the apparatus 10, the golfer, and the club as shown in 7A. FIG. 9A illustrates how the hips have pivoted and the apparatus has moved when the club has reached the position attained at the end of the back swing. It will be appreciated that the golfer's arm 44 has been kept in engagement with the apparatus 10 and within recess 30 until hip movement or rotation is completed and the arms are disengaged from the club when completing the swing. FIG. 10A shows the relative positions of the golfer's hips, apparatus 10 and club after completion of the complete swing.

FIG. 6B shows the apparatus 10 in two other alternative positions relative to the golfer. The dotted line position of FIG. 10 is merely a depiction of how the apparatus 10 can be moved completely out of the way when not being employed. In the solid line depiction of FIG. 6B, apparatus 10 has been moved to the center of the golfer's body. Such a position is of value when making chip shots. The apparatus positions of FIGS. 6 and 6A, on the other hand, are to be employed when the golfer is making a more or less complete swing as in the case of a drive or long shot down a fairway.

Figure 11:
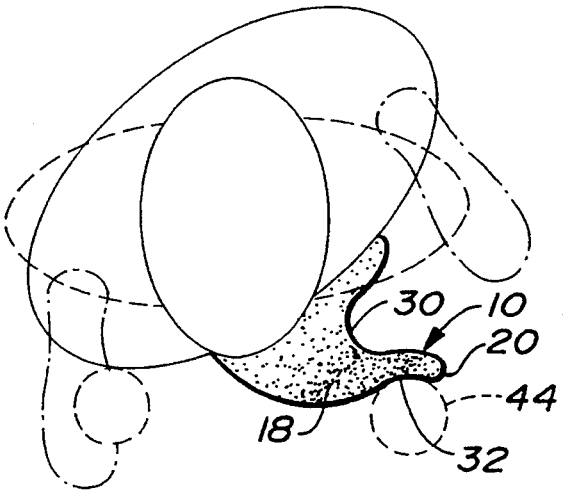
FIG. 11 is a top diagrammatic view of a golfer with the apparatus shown in the position relative to his body as illustrated in FIG. 6B when making a chip shot.
Figure 12:
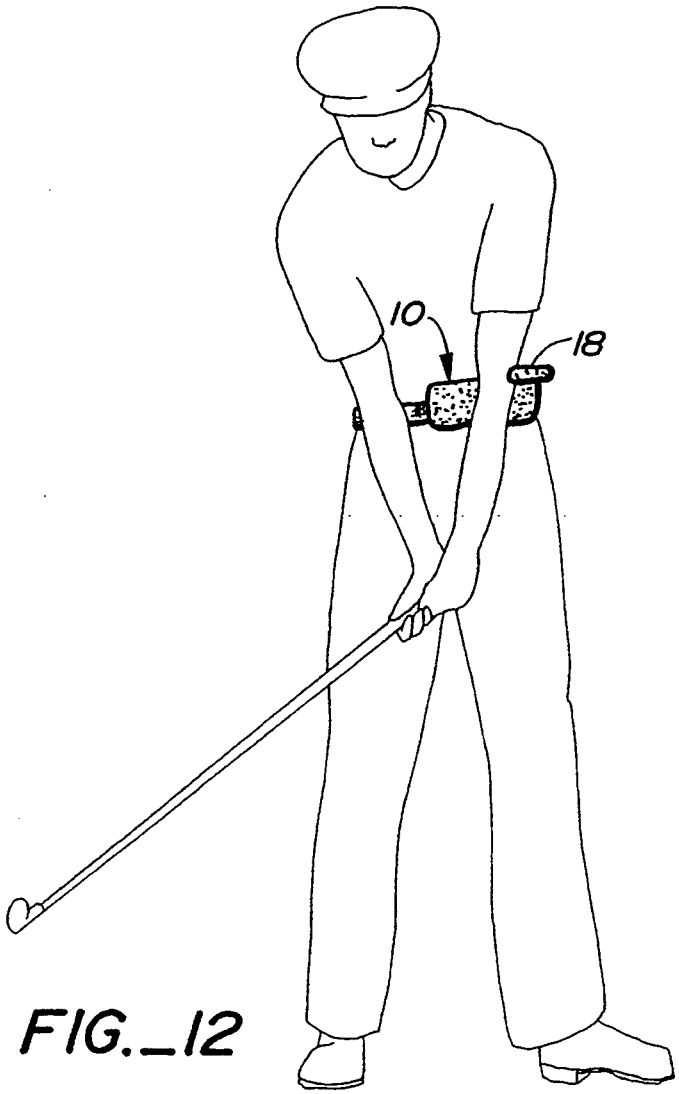
FIG. 12 is a frontal elevational view of a golfer positioned for a chip shot with the apparatus positioned on his body as illustrated in FIGS. 6B and 11.

In the FIG. 6B position, the golfer places his leading arm 44 against the apparatus 10 in recess 32. This is shown in FIGS. 11 and 12. The golfer, when making a chip shot, steps up to the ball and steps back on his left foot. His hips rotate and apparatus 10 moves so that the elongated guide member 18 points in the direction that the ball is to be hit. In FIG. 11 the shoulder's positions are depicted by dash lines while the golfer's hip is depicted in solid lines. During rotation of the hip, the golfer maintains contact with the apparatus 10, thus following hip rotation, at least until the ball is hit.

Referring once again to FIG. 6A, the illustrated orientation of the apparatus can be employed when putting. Preferably, the apparatus is positioned chest high. By maintaining the arm in engagement with the apparatus as shown, the arm will be locked into position and move with the golfer's shoulders.

It will be seen from the above that the apparatus of the present invention can be moved to different positions on the golfer's body on his or her waist to accommodate not only different swings but to accommodate the degree of athletic prowess of the athlete as well. The flexible panel 12 and the belt 14 ensure proper placement of the elongated guide member 18 relative to the golfer's body regardless of where the apparatus 10 is positioned on the golfer's waist.

I claim:

1. Apparatus to be worn by a golfer for guiding the wearer's golf swing when hitting a ball to a target location spaced from the wearer, said apparatus comprising, in combination:

attachment means for attaching the apparatus to the wearer's waist;

stabilizer means for stabilizing the position of said apparatus relative to the wearer's waist when the apparatus is attached thereto by said attachment means; and an elongated guide member having opposed first and second sides secured to said stabilizer means and projecting outwardly and upwardly from said stabilizer means, said first and second sides being spaced from one another and said first side generally facing toward the target location when on a wearer's waist and said second side generally facing away from the target location when on a wearer's waist, said elongated guide member for engagement by at least one arm of the wearer during at least a portion of either the wearer's back swing or the wearer's down swing, said elongated guide member having a free distal end spaced from the wearer's body and defining a first recess at the first side thereof for receiving an arm of the wearer during at least a portion of either the back swing or the down swing and said elongated guide member further defining a second recess at the second side thereof for the receiving an arm of the wearer during at least a portion of the back swing or the down swing, and said stabilizer means maintaining said free distal end positioned outwardly of and at a level above the wearer's waist during both the back swing and the down swing for observation by the wearer.

2. The apparatus according to claim 1 wherein said elongated guide member includes a first guide member segment extending outwardly from the wearer's body substantially at right angles to the major axis of the wearer's body, a second guide member segment connected to the first guide member segment at a location spaced outwardly away from the wearer's waist, said second guide member segment extending upwardly a predetermined distance from said first guide member segment to a level above the wearer's waist, and a third guide member segment connected to and extending outwardly away from said second guide member segment and extending outwardly away from the wearer's body, said third guide member segment terminating at said free distal end.

3. The apparatus according to claim 2 wherein said stabilizer means and said elongated guide member are formed from material resisting relative movement between said stabilizer means and said elongated guide member.

4. The apparatus according to claim 1 wherein said stabilizer means and said elongated guide member are of unitary construction.

5. The apparatus according to claim 4 wherein said stabilizer means and said elongated guide member are at least partially formed of molded, plastic material.

6. The apparatus according to claim 1 wherein said elongated guide member is curved at said first side to define said first recess and curved at said second side to define said second recess.

7. The apparatus according to claim 1 wherein said stabilizer means comprises a flexible panel for positioning at least partially about the wearer's waist and in engagement therewith, said attachment means cooperating with said panel to permit selective positioning of said panel and said elongated guide member at alternative locations on the wearer's waist to guide the wearer's arms for different types of swings.

8. The apparatus according to claim 1 wherein said first and second recesses are located between said free distal end and said stabilizer means.

* * * * *